US008029390B2

(12) United States Patent
Winningham et al.

(10) Patent No.: US 8,029,390 B2
(45) **Date of Patent: *Oct. 4, 2011**

(54) REINFORCED LACROSSE HEAD AND RELATED METHOD OF MANUFACTURE

(75) Inventors: Matthew M. Winningham, Royal Oak, MI (US); Joshua G. Schmidt, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 217 days.

This patent is subject to a terminal disclaimer.

(21) Appl. No.: 12/558,084

(22) Filed: Sep. 11, 2009

(65) Prior Publication Data

US 2010/0000656 A1 Jan. 7, 2010

Related U.S. Application Data

(63) Continuation-in-part of application No. 11/832,743, filed on Aug. 2, 2007, now Pat. No. 7,547,261, which is a continuation of application No. 10/437,842, filed on May 14, 2003, now Pat. No. 7,258,634, application No. 12/558,084, which is a continuation-in-part of application No. 11/753,959, filed on May 25, 2007, now Pat. No. 7,749,113, which is a continuation-in-part of application No. 10/437,842, said application No. 11/753,959 is a continuation-in-part of application No. 10/437,542, filed on May 14, 2003, now Pat. No. 7,226,374, application No. 12/558,084, which is a continuation-in-part of application No. 11/832,753, filed on Aug. 2, 2007, now Pat. No. 7,695,382, which is a continuation of application No. 10/437,842, application No. 12/558,084, which is a continuation-in-part of application No. 11/832,760, filed on Aug. 2, 2007, now Pat. No. 7,704,171, which is a continuation of application No. 10/437,842.

(60) Provisional application No. 61/097,688, filed on Sep. 17, 2008, provisional application No. 60/380,547, filed on May 14, 2002, provisional application No. 60/418,992, filed on Oct. 15, 2002.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/505, 512; D21/724; 156/73.1
See application file for complete search history.

(56) References Cited

U.S. PATENT DOCUMENTS 0,236,045 A 12/1880 Kreutzer (Continued)

FOREIGN PATENT DOCUMENTS

GB 0424742 2/1935

(Continued)

OTHER PUBLICATIONS

Web page download, Devco Design and Development, 1998, http://devco-design.com/mi-mold.htm, 3pp.

(Continued)

*Primary Examiner* — Gene Kim
*Assistant Examiner* — M Chambers
(74) *Attorney, Agent, or Firm* — Warner Norcross & Judd LLP

(57) ABSTRACT

A reinforced lacrosse head having improved strength can include the following frame elements: a pair of opposing sidewalls each having a top end and a bottom end, a scoop extending between the sidewalls, a base extending between the bottom ends of the sidewalls, and a throat extending from the base for attachment to a lacrosse handle. The head can include at least one reinforcement member that is located at least partially in a frame element. The frame element can be constructed from two or more parts that are sonic welded or hot plate welded together around at least a portion of the reinforcement member. Methods of sonic welding or hot plate welding components of a reinforced frame element also are provided.

20 Claims, 5 Drawing Sheets

U.S. PATENT DOCUMENTS

| | | | | |
|---|---|---|---|---|
| 1,555,164 | A | 9/1925 | Schwartz | |
| 1,611,858 | A | 12/1926 | Middlekauff | |
| 1,750,644 | A | 3/1930 | Norton | |
| 2,274,788 | A | 3/1942 | J. Hatton | |
| 2,902,072 | A | 7/1958 | F. G. Reuter | |
| 3,479,030 | A | 11/1969 | Merola, Anthony | |
| 3,583,611 | A * | 6/1971 | Theodore | 224/624 |
| 3,701,374 | A | 10/1972 | McGillvary | |
| 3,910,578 | A | 10/1975 | Brine, Jr. | |
| 4,098,508 | A | 7/1978 | Gandy | |
| 4,119,313 | A | 10/1978 | Popplewell et al. | |
| 4,129,635 | A | 12/1978 | Yasuike et al. | |
| 4,338,708 | A * | 7/1982 | Hanson et al. | 445/22 |
| 4,683,784 | A | 8/1987 | Lamont | |
| 4,830,812 | A | 5/1989 | Kauer | |
| 5,028,377 | A | 7/1991 | Hendry | |
| 5,054,790 | A | 10/1991 | Brine et al. | |
| 5,075,056 | A | 12/1991 | Umlauft et al. | |
| 5,118,455 | A | 6/1992 | Loren | |
| 5,421,574 | A | 6/1995 | Yamagishi et al. | |
| 5,470,649 | A | 11/1995 | Farley | |
| 5,568,925 | A | 10/1996 | Morrow et al. | |
| 5,651,549 | A | 7/1997 | Dill et al. | |
| 5,685,791 | A | 11/1997 | Feeney | |
| 6,066,056 | A | 5/2000 | Morrow | |
| 6,213,901 | B1 | 4/2001 | Collinson | |
| 6,439,074 | B1 | 8/2002 | Stencel | |
| 6,676,547 | B1 | 1/2004 | Morrow et al. | |
| 6,723,134 | B2 | 4/2004 | Tucker, Sr. | |
| 6,976,701 | B2 | 12/2005 | Gray et al. | |
| 7,226,374 | B2 * | 6/2007 | Morrow et al. | 473/513 |
| 7,258,634 | B2 * | 8/2007 | Morrow et al. | 473/512 |
| 7,547,261 | B2 * | 6/2009 | Morrow et al. | 473/513 |
| 7,695,382 | B2 * | 4/2010 | Morrow et al. | 473/513 |
| 7,704,171 | B2 * | 4/2010 | Morrow et al. | 473/513 |
| 7,749,113 | B2 * | 7/2010 | Morrow et al. | 473/513 |
| 2002/0098924 | A1 | 7/2002 | Houser et al. | |

FOREIGN PATENT DOCUMENTS

| | | |
|---|---|---|
| JP | 2000-61005 | 2/2000 |

OTHER PUBLICATIONS

Web page download, Plastics Technology, Apr. 5, 2006, www.plasticstechnology.com/articles/article_print1.cfm, 2 pp.

Web page download, Nitrojection, Apr. 5, 2006, www.nitrojection.com, 4 pp.

Web page download, Bayer, Apr. 5, 2006, www.bayerone.com, 6 pp.

* cited by examiner

REINFORCED LACROSSE HEAD AND RELATED METHOD OF MANUFACTURE

CROSS-REFERENCE TO RELATED APPLICATIONS

This application claims benefit of U.S. Provisional Application No. 61/097,688, filed Sep. 17, 2008, which is incorporated by reference herein. This application is also a continuation-in-part application of U.S. application Ser. No. 11/832,743 filed on Aug. 2, 2007, which is a continuation of U.S. application Ser. No. 10/437,842 filed on May 14, 2003 (now U.S. Pat. No. 7,258,634), which claims priority from U.S. Provisional Application No. 60/380,547 filed on May 14, 2002, the disclosures of which are all incorporated by reference herein. This application is also a continuation-in-part of U.S. application Ser. No. 11/753,959 filed on May 25, 2007, which is (a) a continuation-in-part of U.S. application Ser. No. 10/437,842 filed on May 14, 2003 (now U.S. Pat. No. 7,258,634), which claims priority from U.S. Provisional Application No. 60/380,547 filed on May 14, 2002; and (b) a continuation-in-part of U.S. application Ser. No. 10/437,542 filed on May 14, 2003 (now U.S. Pat. No. 7,226,374), which claims priority to U.S. Provisional Application No. 60/418,922 filed on Oct. 15, 2002, the disclosures of which are all incorporated by reference. This application is also a continuation-in-part application of U.S. application Ser. No. 11/832,753 filed on Aug. 2, 2007, which is a continuation of U.S. application Ser. No. 10/437,842 filed on May 14, 2003 (now U.S. Pat. No. 7,258,634), which claims priority from U.S. Provisional Application No. 60/380,547 filed on May 14, 2002, the disclosures of which are all incorporated by reference herein. This application is also a continuation-in-part of U.S. application Ser. No. 11/832,760 filed on Aug. 2, 2007, which is a continuation of U.S. application Ser. No. 10/437,842 filed on May 14, 2003 (now U.S. Pat. No. 7,258,634), which claims priority from U.S. Provisional Application No. 60/380,547 filed on May 14, 2002, the disclosures of which are all incorporated by reference herein.

BACKGROUND OF THE INVENTION

The present invention relates generally to a lacrosse head for attachment to a lacrosse stick, and more particularly to a lacrosse head having increased strength without substantially increasing the weight of the lacrosse head.

Lacrosse heads are used in the game of lacrosse for catching, holding and shooting a lacrosse ball. Most current lacrosse heads are manufactured using plastic injection molding processes, and are secured to a lacrosse handle. A typical lacrosse head includes a throat that is connected to a lacrosse handle, a base adjacent the throat and including a ball stop, a pair of opposing sidewalls that generally diverge from the base, and a scoop that joins the ends of the opposing sidewalls opposite the base. Lacrosse heads also typically include netting attached to the rear side of the base, the sidewalls and the scoop. This netting ordinarily is used to retain a lacrosse ball in the lacrosse head.

The sidewalls of current lacrosse heads typically have an open sidewall construction that includes many openings formed in the sidewalls. This open-frame construction decreases the amount of material used to form the sidewalls and thus the head, thereby decreasing the overall manufacturing and material costs for the head.

One proposed solution to this structural weaknesses provides stiffening ribs integrally formed in the head and extending from the socket or the base on toward the scoop. The stiffening ribs typically are located above and below the sidewall openings to provide structural support. The stiffening ribs usually are thicker than the main portion of the sidewalls to increase the structural integrity of the sidewalls. In such a construction, the lacrosse head is constructed from plastic with the stiffening ribs integrally molded as part of the head during a single molding process. Unfortunately, however, the stiffening ribs may not be sufficiently strong to prevent deformation or breakage of the lacrosse head. Such ribs also can add too much material, and thus weight, to the lacrosse head, thereby yielding an undesirably heavy lacrosse head.

SUMMARY OF THE INVENTION

A reinforced lacrosse head is provided which includes a frame having a pair of opposing open sidewalls, each having a top end and a bottom end, with one or more cross members, a scoop extending between the top ends of the sidewalls, a base extending between the bottom ends of the sidewalls, and a throat extending from the base for attachment to a lacrosse handle.

In one embodiment, at least one reinforcement member can be joined with at least one portion of the frame, for example, a reinforcement member can be included in at least one of the sidewalls, the scoop, the base and the throat.

In another embodiment, the reinforcement member can be constructed from metal, composites, plastics, or the like, and can take on a variety of geometric shapes, such as wire-like cylinders or tubes (single or bundles), flattened bars, or plates, any of which can be embedded in a plastic material that forms one or more frame elements. The reinforcement member can be located anywhere in the lacrosse head where additional strength is desired. Optionally, the reinforcement member can be embedded within the plastic of the frame element a sufficient distance from the exterior surface of the frame element to resist breakage upon impact from a lacrosse ball or stick.

In yet another embodiment, a method for making the reinforced lacrosse head is provided. In this method, a frame element, such as a sidewall, base, scoop, and/or throat and/or portions thereof, is constructed with an open region that is sized to accommodate a reinforcement member. The reinforcement member can be positioned at least partially within the open region. Another, separately formed portion of the frame element (referred to as a secondary part) can be positioned adjacent the open region, over at least a portion of the reinforcement member. The secondary part and the frame element can be joined by compressing them together, while applying high frequency oscillations or vibrations to the secondary part and/or the frame element to sonically weld them together and form a completed frame element. As a result, the reinforcement member can be at least partially embedded within the plastic material constituting the completed frame element, thereby forming a unitary reinforced lacrosse head. A similar method can be used to add multiple reinforcement members to various frame elements of the lacrosse head.

In a further embodiment, at least one of the open region and the secondary part can include an engagement surface that defines a recess or groove within which the reinforcement member can be positioned. The reinforcement member can be positioned within the recess, so that the engagement surface straddles the reinforcement member, that is, the engagement surface has first and second areas on opposite sides of the reinforcement member. The secondary part can be positioned adjacent the open region over at least a portion of the reinforcement member. The secondary part and the frame element can be joined by compressing them, while applying high frequency vertical vibrations to the secondary part and/or the frame element to sonically weld them together and form a completed frame element.

In yet a further embodiment, the optional recess within which the reinforcement member can be placed can be of a pre-selected depth. This pre-selected depth can be greater than, less than, or the same as the largest cross sectional dimension of the reinforcement member. Where it is less than or the same as the largest dimension, at least one of the frame element and the secondary part can be joined directly with the reinforcement member, optionally by plasticizing or melting the frame element and/or secondary part by sonic welding it to the reinforcement member. Where the pre-selected depth is greater than the largest dimension, the frame element and the secondary part can be sonically welded together without direct bonding of either component to the reinforcement member. Optionally, the reinforcement member can be housed within the recess, and effectively embedded in the frame, but not bonded to either the frame element or the portion. Further optionally, this configuration can enable the reinforcement member to float freely within the recess.

In another, further embodiment, the secondary part, frame element and reinforcement member can be joined in a hot plate welding process. This process can include: heating the frame element and secondary part in regions that are desired to be bound together so that those regions at least partially melt; placing the reinforcement member between the frame element and the secondary part; compressing the secondary part and frame element together with the reinforcement member at least partially therebetween; and allowing the secondary part and the frame element to cool to a welded together state, with the reinforcement member joined with at least one of those components. Optionally, the reinforcement member may also be heated before the secondary part and frame element are joined. Further optionally, at least one of the secondary part and frame element can define a recess or groove within which the reinforcing member can be positioned, similar to the sonic weld embodiments above.

A reinforced lacrosse head is provided having increased strength and resistance to deformation or breakage, yet which optionally is still substantially lightweight as compared to current lacrosse heads. Further, the present lacrosse head requires less plastic, thereby decreasing the amount of time required for cooling the plastic and consequently decreasing the overall manufacturing cycle time of the lacrosse head.

These and other objects, advantages, and features of the invention will be more fully understood and appreciated by reference to the description of the current embodiment and the drawings.

DETAILED DESCRIPTION OF THE CURRENT EMBODIMENT

A current embodiment of the reinforced lacrosse head is shown in FIGS. 1-4 and generally designated 10. The current embodiment is described in connection with lacrosse heads having sidewalls or other frame elements of an open-frame construction, that is, where the frame elements include apertures or holes to reduce weight or material. Other embodiments may be lacrosse heads of different configurations, including non-open or solid sidewall lacrosse heads and straight-walled lacrosse heads.

Figure 1:
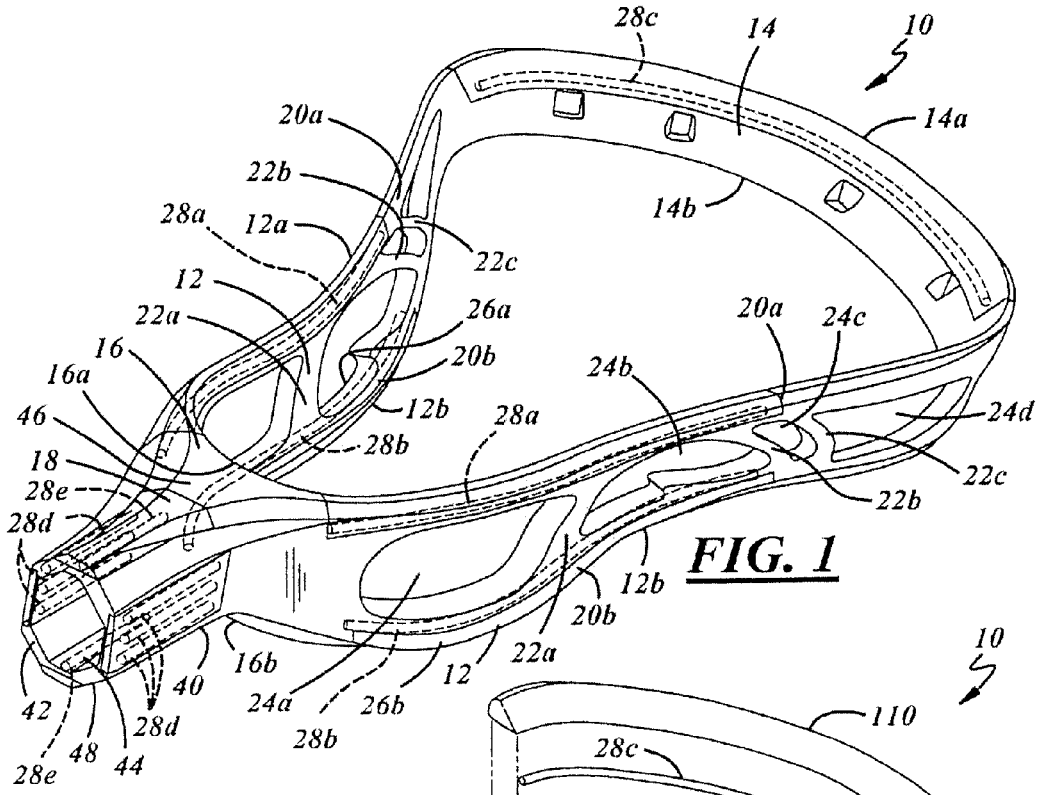
FIG. 1 is a perspective view of a reinforced lacrosse head having multiple reinforcement members according to a current embodiment.
Figure 2:
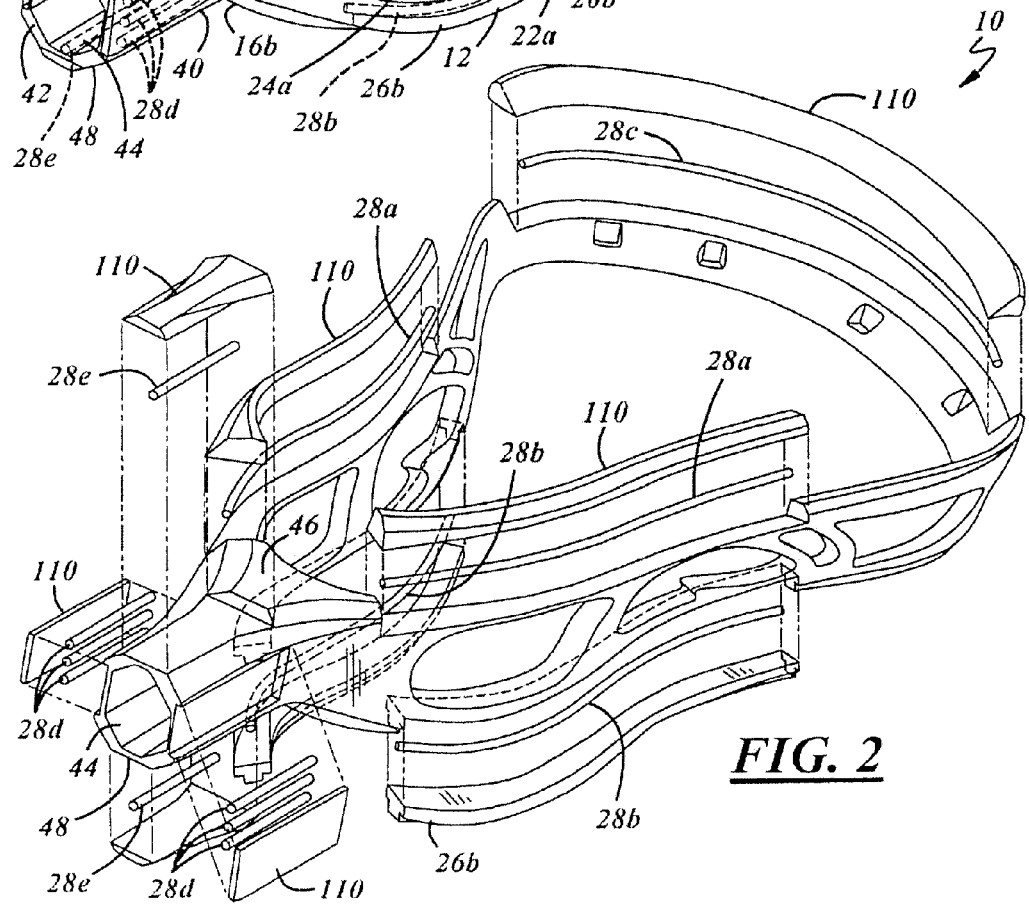
FIG. 2 is an exploded perspective view of the reinforced lacrosse head.

Referring to FIGS. 1 and 2, the reinforced lacrosse head 10 can include a frame constructed of multiple frame elements, for example, a pair of opposing sidewalls 12 each having a top end and a bottom end, a scoop 14 extending between and connecting the top ends of the sidewalls 12, a base 16 extending between and connecting the bottom ends of the sidewalls 12, and a throat 18 extending from the base 16 for attachment to a lacrosse handle. The sidewalls 12, the scoop 14, and the base 16 can include respective front edge portions or upper rims 12*a*, 14*a*, 16*a* that define a ball receiving or catching area and rear edge portions or lower rims 12*b*, 14*b*, 16*b* that define a ball possession or retaining area.

The sidewalls 12 can have an open-frame construction, as noted above. More particularly, each sidewall 12 can include two or more rail portions 20*a*, 20*b* with one or more cross members 22*a*, 22*b*, 22*c* extending between those rails, optionally connecting the rails at different locations. Further optionally, the rail portions 20*a*, 20*b* and the cross members 22*a*, 22*b*, 22*c* cooperatively define one or more openings that extend completely through the sidewall. As shown, openings 24*a*, 24*b*, 24*c*, 24*d* are defined by the sidewall 12. This open-frame construction can substantially decrease the amount of material used to form the sidewalls 12 and thus the head, thereby decreasing the overall weight of the lacrosse head 10. Optionally, the number, size and geometric configuration of the rail portions, cross members and openings can vary as desired.

Each rail portion 20*a*, 20*b* optionally can include at least one stiffening rib 26*a*, 26*b* for strengthening the respective rail portion 20*a*, 20*b* as well as the respective sidewall. In one embodiment, each stiffening rib 26*a*, 26*b* can be a thicker integral part of its respective rail portion 20*a*, 20*b* and can extend the length of the rail portion 20*a*, 20*b* from the base 16 to the scoop 14. Moreover, each stiffening rib 26*a*, 26*b* can extend to the throat 18 to provide additional structural integrity thereto. Additionally, the stiffening ribs 26*a*, 26*b* can be located in the sidewall 12 above and below the openings 24*a*, 24*b*, 24*c*, 24*d* to provide structural support thereto. However, the stiffening ribs can be located in a variety of different locations on the lacrosse head. The term stiffening ribs can encompass areas of the sidewall that are thicker than the surrounding portions of the sidewall 12.

The reinforced lacrosse head 10 generally includes one or more reinforcement members 28 for strengthening the lacrosse head 10. As shown in FIGS. 1-5, a number of reinforcement members 28*a*, 28*b*, 28*c*, 28*d*, and 28*e* are included in various frame elements of the lacrosse head 10.

Figure 5:
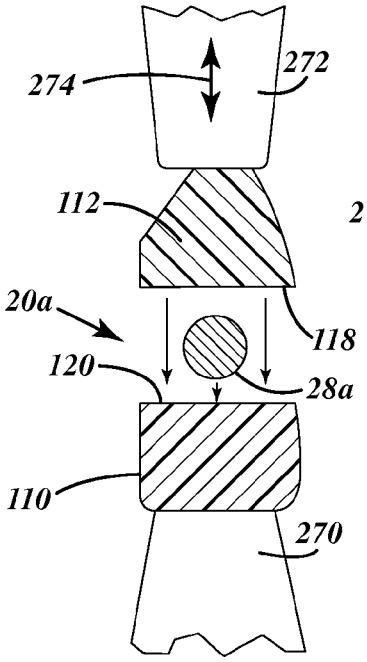
FIG. 5 is the frame element and reinforcement member before sonic welding.
Figure 6:
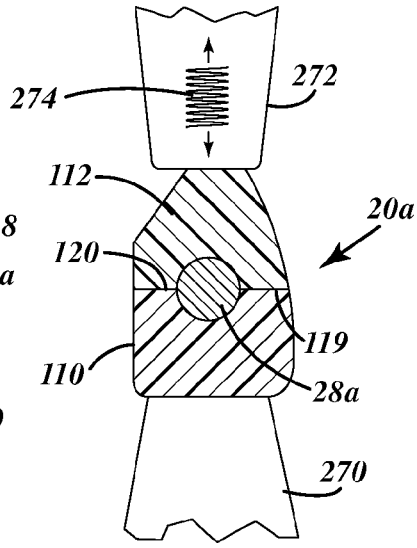
FIG. 6 is the frame element and reinforcement member after sonic welding.

In general, the reinforcement members can be constructed in a variety of geometries, cross sections and shapes, and from a variety of materials. For example, the reinforcement members each can be in the form of a bar, a wire, a tube, or an elongated plate of any cross section or length (all of which are referred to herein as a bar). In such a construction, the bar can be of a variety of cross sections, for example, of rounded, circular, elliptical, triangular, square, rectangular, hexagonal, octagonal cross sections. The cross sections can also vary, so that the reinforcement member tapers from one end to the other constantly or in a varying manner. Optionally, where the member is a bar of a plate construction, the bar can be contoured for inclusion within a particular frame element of the lacrosse head. Further optionally, where the member is a bar construction, the bar can be contoured or bent to follow the contour or shape of the frame element in which is embedded or otherwise included. Even further optionally, as shown in FIGS. 5 and 6, the cross section of the bar 28*a* can vary from the cross section of the frame component 20*a* within which it is included. For example, the bar can be of a circular cross section while the frame component is of an irregularly shaped polygonal cross section.

The reinforcement member can also be constructed from a solid core construction, in which the core is generally a homogeneous material throughout its cross section. Alternatively, the member can be of a cable like construction, or can have multiple bundles of individual fibers or smaller bars or wires aligned with one another side by side or placed end to end or in an overlapping configuration. The member can further be of a fabric or non-fabric construction, the latter generally including the bar construction mentioned above.

The reinforcement member can be constructed from a strong lightweight metal, for example, aluminum, titanium, steel, magnesium, or alloys including any or all of the forgoing metals. Alternatively, the member can be constructed from other suitable strong lightweight materials, for example, graphite, fiberglass, composite plastics, ceramics/polymer composites, combinations of the foregoing (including the metals above), and any other suitable materials.

Although not shown, the size and thickness of the reinforcement members 28 can vary from the illustrations in FIGS. 1-4. For example, the length of reinforcement member 28*a* shown in FIGS. 1-2, or FIGS. 3-4, can be shorter or longer that illustrated. Further, the thickness of the reinforcement member 28*a* in FIGS. 1-2 or 3-4 can vary from how it is illustrated. Moreover, the thickness of the reinforcement member 28*a* in FIGS. 1-2 or 3-4 can vary along their respective lengths (i.e. the thickness of a respective reinforcement member can be non-uniform along its length). In each of these alternative embodiments, the overall strength of the lacrosse head, as well as the strength of the lacrosse head at various locations, can be precisely tuned as desired.

Moving to the placement of the reinforcement members, they can be of positioned within any frame element in which increased strength and/or rigidity is desired, and indeed can traverse multiple frame elements as desired, or can be isolated in selected frame elements, terminating short of other frame elements. As shown in FIG. 1, a first reinforcement member 28*a* can be included in a portion of the upper rail 20*a* of each of the pair of sidewalls 12 extending approximately from the throat 18 to an area short of the scoop 14, for example, near the third opening 24*c*. The reinforcement member 28*a* can be positioned within the sidewall 12 a pre-selected distance from the front edge 12*a*, in the area generally considered to be proximal an optional stiffening rib 26*a*, so that sufficient plastic material is between the reinforcement member and the front edge 12*a* to substantially resist cracking, chipping or breaking of the front edge 12*a* when that edge is impacted by a lacrosse ball, another player's lacrosse stick, or other object. For example, the pre-selected distance can be at least about 0.5 inch, 0.25 inch, 0.125 inch, 0.1 inch, or about 0.05 inch. Further, the reinforcement members 28*a* can provide a generally rigid and relatively non-deformable overall construction to the respective upper rails 20*a*.

As also shown in FIGS. 1 and 2, a second reinforcement member 28*b* can be included in a portion of the lower rail 20*b* of each of the pair of sidewalls 12 extending approximately from the throat 18 to an area short of the scoop 14, for example, near the third opening 24*c*. Like the first reinforcement members 28*a*, the second reinforcement members 28*b* optionally can be disposed a pre-selected distance from the rear edge 12*b* to substantially resist cracking, chipping or breaking of the rear edge 12*b* when that edge is impacted. Further, the reinforcement members 28*b* can provide a generally rigid and relatively non-deformable overall construction to the respective lower rails 20*b*. In general, either the front edge or the rear edge of the lacrosse head are referred to as an exterior edge herein.

A third reinforcement member 28*c* can be included in the scoop 14 and can extend substantially the length of the scoop, between the respective sidewall portions 12, if desired. The third reinforcement member 28*c* can likewise be positioned a pre-selected distance below the upper rim or exterior of the scoop to substantially resist breakage of the upper rim and the like upon impact. Further, the reinforcement member 28*c* provide a generally rigid and relatively non-deformable overall construction to the scoop portion 14.

A number of additional reinforcement members 28*d* can be included in each side region 40 of the throat 18 between the base 16 and the rearward most portion 42 of the base. These reinforcement members 28*d* can provide additional strength to the throat region 18 resulting from sideways movement of a lacrosse handle (not shown) located within the throat interior 44 during use. In addition, one or more reinforcement members 28*e* can be included in the top portion 46 and bottom portion 48 of the throat 18 to provide additional strength there to counter forces resulting from up and down movement of the handle within the interior 44 of the throat 18. The reinforcement members 28*d*, 28*e* also can provide a general rigid and relatively non-deformable overall construction to the throat 18 and to the base 16. Optionally, the throat can include one or more reinforcement elements that extend toward the rearward most portion 42 of the base, but terminate at or near that location. In this construction, the members fail to extend into the handle, and in fact terminate proximal the handle, which can be located within the throat in most applications.

As shown in FIGS. 1-6, the reinforcement members 28 can be included or embedded a sufficient distance from the front edge 12*a*, 14*a*, 16*a* to enable that front edge 12*a*, 14*a*, 16*a* to slightly locally deform a predetermined amount, for example, 0.001 mm to about 0.1 mm, or other amounts, depending on the application. This deformation is due to the physical deformation properties of the plastic material, and enables the edge to absorb a portion of an impacting lacrosse ball's kinetic energy. Accordingly, the front edge 12*a*, 14*a*, 16*a* can decrease the speed of a ball and improve the player's ability to retrieve or catch the ball.

Although not shown, it is also contemplated that a single reinforcement member 28 can be integrated in and can extend across more than one portion or frame element of the lacrosse head. For example, a bar having the general shape of the lacrosse head frame can be integrated within two or more of the scoop 14, the upper rails 20*a*, the lower rails 20*b*, the base 16 and throat 18. Optionally, the reinforcement member in a bar construction can extend continuously from one frame element to one or more other elements as desired, or the member can terminate within one frame element, stopping short of another frame element as desired. Further optionally, although not shown, the reinforcement elements 20*a* in the opposing sidewalls can be connected through the base 16, to form a generally U-shaped reinforcement member, and/or can be connected through the scoop, to form a different U-shaped reinforcement member or a loop shaped reinforcement structure. Corresponding secondary parts, of similar shape, can be included in the head in these embodiments if desired.

Figure 3:
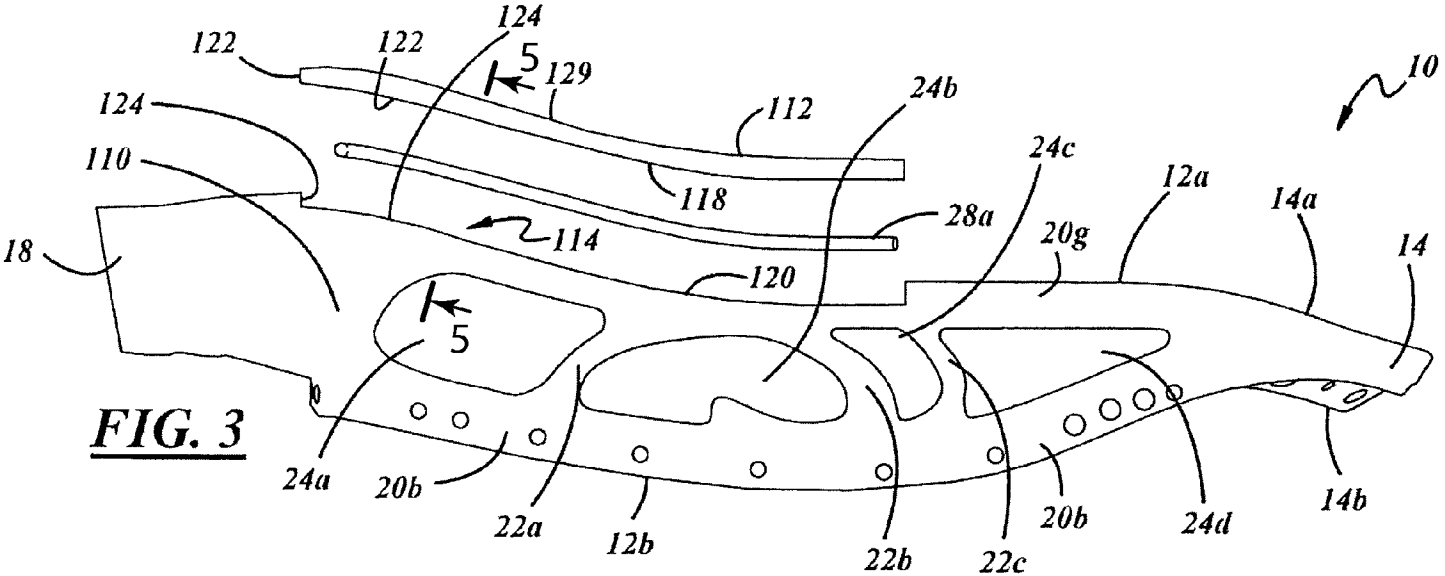
FIG. 3 is a side view of the reinforced lacrosse head illustrating a sidewall being constructed to include a reinforcement member.
Figure 4:
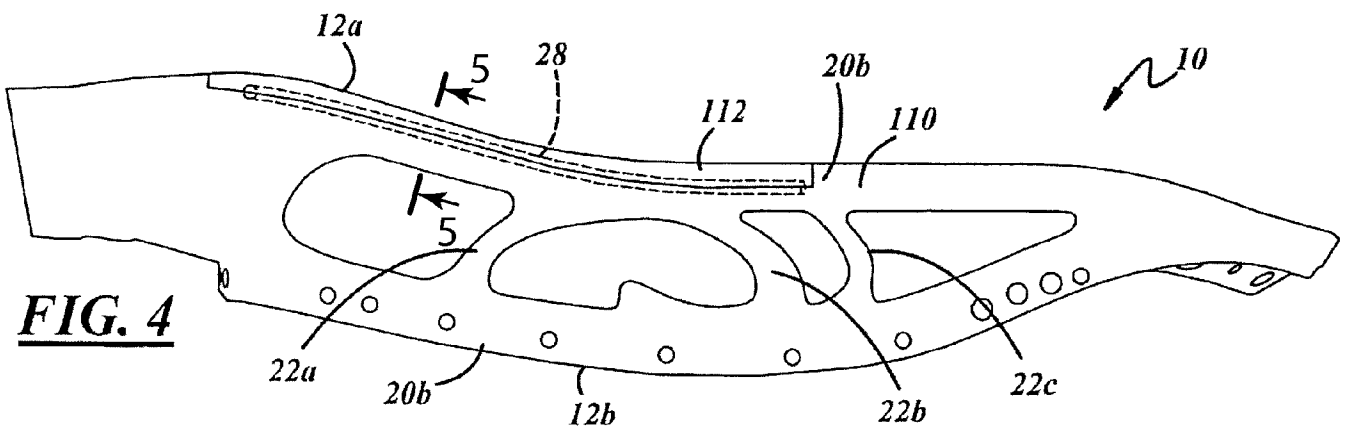
FIG. 4 is a side view of the reinforced lacrosse head of FIG. 3 in a constructed form.

While FIGS. 1-2 show reinforcement members 28 located in multiple portions of the lacrosse head 10, the lacrosse head 10 can be formed having reinforcement members 28 located in less than all the locations illustrated. For example, as shown in FIGS. 3-4, a head can be formed wherein reinforcement members 28*a* are only added to the upper rail portions 20*a* of the sidewall portions 12.

Figure 7:
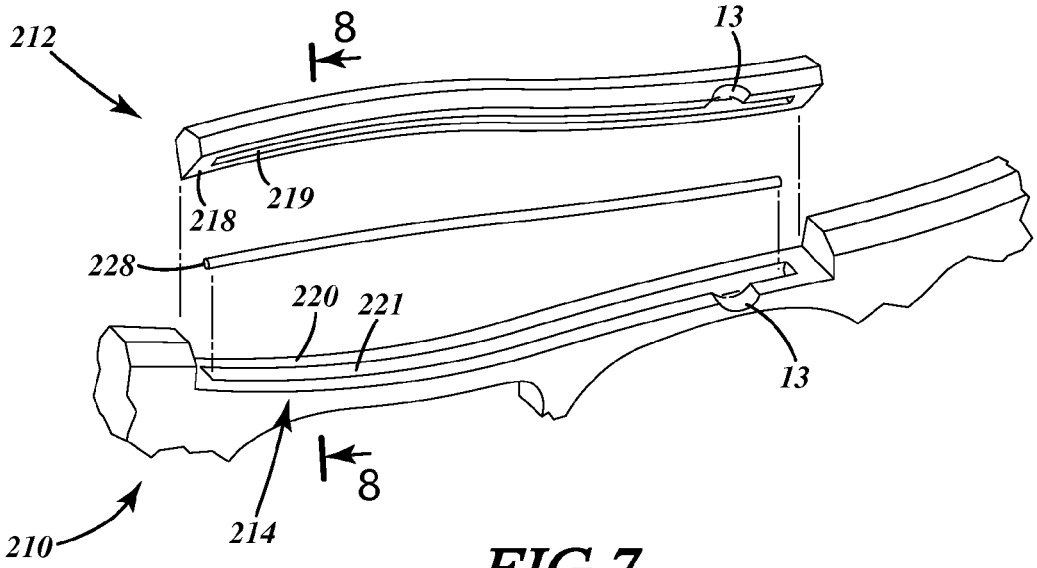
FIG. 7 is a second embodiment of a frame element of the lacrosse head before a reinforcement member is joined with the frame element.

In addition, although not shown in the embodiment of FIGS. 1-4, any of the frame elements having reinforcement members optionally can include verification or viewing windows 13 as shown in FIG. 7. Such windows provide a hole, recess or aperture that enables a viewer of the head 10 to view the reinforcement member 28 within the element, and verify by sight of the partially exposed member that the head in fact includes the reinforcement member.

FIGS. 3-6 illustrate steps of forming a reinforced lacrosse head in which the reinforcement member 28 is included in a frame element (as shown, the upper rail 20*a* of a sidewall 12) via sonic welding, to form a unitary reinforced lacrosse head 10. As shown there, a frame element 110, a reinforcement member 28 and second portion 112 are provided. These components can be constructed before the below procedure. For example, the frame element and secondary part can be molded and completely cooled and cured before assembling in the manner outlined below.

Returning to FIGS. 3-6, the reinforcement member 28 or 28*a* can be introduced onto or into a frame element 110, which again, for example, can be a portion of the respective upper rail portion 20*a* and/or rib portion 26*a* or virtually any other component of the head. A second portion, also referred to as a secondary part 112, which includes an additional portion of the upper rail 20*a* and/or a portion of the rib portion 26*a*, is positioned over the reinforcement member 28 or 28*a*. The secondary part 112 is sonic welded to the frame element 110 along the surfaces on opposite sides of the reinforcement member so that the secondary part 112 and frame element 110 plasticize and join with one another at their interface to form a unitary structure wherein the reinforcement member 28 or 28*a* is included in at least one of the frame element 110 and the secondary part 112, and thus, the head. During the sonic welding, the reinforcement member also can become embedded in at least one of the frame element and the secondary part, due to the plastic or material of the frame element and secondary part plasticizing or melting under the friction generated by the sonic welding process.

More particularly, the frame element 110 and secondary part 112 can be pre-formed, for example, injection molded (2-shot, gas-assist, or otherwise), extruded or machined to their desired shapes using conventional techniques. In many applications, the frame element and secondary part may have different cross sections from one another, and from the cross section of the reinforcement element. The first portion of the frame element 110 can constitute a majority of the frame element with the exception of a specific portion of the upper rail 20*a*. In this construction, the frame element can define an open region 114, which generally can be a missing portion of the frame element 110. This open region 114 can include an engagement surface 120, which corresponds in size and optionally in shape to an engagement surface 118 of the secondary part 112, so that when the two are sonically welded together, minimal finishing operations can be performed to ensure that the components appear as one unitary part. The first portion 110 and the secondary part 112 can also be sized along their respective engagement surfaces 118, 120 to enable the reinforcement member 28*a* to be joined with or placed adjacent those surfaces. Optionally, the reinforcement member 28*a* can be sized or dimensioned shorter or smaller than the open region 114 and/or engagement surface 120 so that the member fits within the open region before welding.

As shown in FIGS. 5 and 6, the secondary part 112 is sonic welded to the first portion of the frame element 110, while capturing the reinforcement element 28 therebetween. In this construction, the engagement surfaces 118 and 120 are relatively flat or planar, however, as discussed below, these surfaces can include various contours both from side-to-side, and along the length of the open region and/or secondary part. In the sonic welding process, the secondary part 112 and frame element 110 are placed between an anvil 272 and a sonotrode 274. The reinforcement member 28*a* is placed between the engagement surfaces 118, 120. The sonotrode and anvil are brought together, with the secondary part 112, reinforcement member 28*a* and frame element 110 being compressed therebetween. Under compression, the sonotrode 272 provides ultrasonic oscillation 274 generally perpendicularly to the engagement surfaces 228 and 120. Due to the compression and oscillation, and subsequent friction, the material adjacent the reinforcement member 28*a* plasticizes or partially melts, thereby enabling the reinforcement member 28*a* to be at least partially embedded in at least one of the engagement surfaces 118, 120. As the sonic welding continues, the engagement surfaces eventually come in contact with one another, and when this occurs, the engagement surfaces 118 and 120 on opposite sides of the reinforcement member 28*a* in areas 119 and 121 also join with one another. Optionally, in this embodiment, the reinforcement member 28*a* can bond directly to the material of the secondary part 112 and the first portion 110 as shown in FIG. 6.

The first portion 110 and the secondary part 112 can be formed from similar or identical materials such as nylon, plastic, and/or other polymers. Optionally, the first portion and secondary part can be constructed from the same material. The composition of the first portion 110 and the secondary part 112, however, can vary to provide different performance characteristics in terms of stiffness and durability, provided that the materials are compatible and can be welded together using the sonic welding or similar joining technique. By way of example, the secondary part 112 can be formed of a more flexible, tougher nylon material than the first portion 110. Optionally, the secondary part 112 can be formed of an elastomeric material (non-nylon) that is compatible with and capable of being sonic welded to the first portion 110. Further optionally, the secondary part itself can be constructed from a more rigid, less flexible, and/or harder or stiff polymer, while the first portion of the frame element can be constructed from a different material that is less rigid, more flexible, and/or softer or less stiff than the secondary part. In such an embodiment, the reinforcement element can be completely absent, with the more rigid secondary part acting as the reinforcement element. Examples of possible materials in this embodiment include a first polymer, such a polyphthalamide plastic material, like FE8200, commercially available from DuPont of Wilmington, Del., used to construct the secondary part, and a second polymer, such as a super tough nylon, like ST801, also commercially available from DuPont, used to construct the frame element. Other material variations can be implemented as desired.

Pre-forming the first portion 110 and second portion 112 and subsequently joining their respective engagement surfaces 118 and 120 by sonic welding can be beneficial over prior conventional methods. In such methods, a titanium wire reinforcement member is placed within a mold, and plastic is injection molded around the wire in the mold so that the entire frame element is formed around the wire in a single stage forming process. In these prior conventional methods, where a titanium wire is molded in a top rim of a sidewall but not the bottom rim, when the frame element cools, the top rim including the titanium wire is prevented from shrinking because the plastic is molded directly to the wire, and thereby restricted from contracting upon cooling. The bottom rim of the sidewall without the titanium wire, however, usually contracts upon cooling and therefore shrinks. Accordingly, the sidewall bows or bends toward the bottom rim of the sidewall, which usually brings the head dimensions out of specification. With the sonic welding method disclosed herein, the parts of a frame element are optionally preformed, and do not undergo the amount of global heating and shrinking as the conventional methods above. Moreover, because the sonic welding provides localized heating of the materials that are joined at the engagement surfaces, less of the frame element and head heats and subsequently cools. Accordingly, most of the issues presented with the uneven shrinkage due to cooling of conventional reinforced heads and methods are eliminated or minimized.

Figure 8:
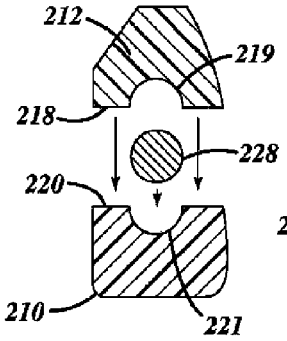
FIG. 8 is a sectional view of the frame element and reinforcement member taken along line 8-8 of FIG. 7 before sonic welding.
Figure 9:
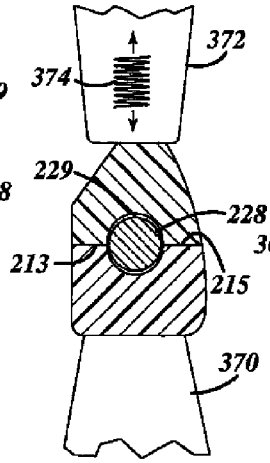
FIG. 9 is a sectional view of the frame element and reinforcement member, being sonic welded together.

Referring to FIGS. 7-9, a second embodiment of the reinforced lacrosse head is shown. There, the frame element of the head can be any of the frame elements described above, that is, a sidewall, a base, a scoop, a throat, or portions thereof, and are generally identical to those described in connection with the embodiments above, with the exception of the frame element first portion 210 and the secondary part 212. Specifically, at least one of the first portion and secondary part can define a recess, groove or aperture to accommodate the reinforcement member 228. As shown, the open region 214 and the secondary part 212 can include respective engagement surfaces 220 and 218 that each define a groove 219 and 221, respectively. These grooves can extend the length of those components, and can be generally aligned with the upper edge of the lacrosse head as desired. Optionally, the grooves can be longer than or the same length as the reinforcement member, depending on the desired amount of axial movement within the groove by the reinforcement member 228.

The reinforcement member 228 can be positioned within the recesses, so that the engagement surfaces straddle the reinforcement member 228, that is, the engagement surfaces can include first 213 and second 215 areas on opposite sides of the reinforcement member (FIG. 9), where those areas are adapted to engage one another and to be sonically welded together. The secondary part 212 can be positioned adjacent the open region 214 over at least a portion of the reinforcement member 228. The secondary part 212 and the frame element portion 210 can be joined by compressing them together between the anvil 370 and sonotrode 372, while applying high frequency vertical vibrations 374 to the secondary part and the frame element to sonically weld them together and form a completed frame element as shown in FIG. 9.

Optionally, the recesses 219 and 220 of this embodiment and the recesses of any other embodiments herein can be of a pre-selected depth, alone or in combination. This pre-selected depth can be greater than, less than, or the same as the largest cross sectional dimension of the reinforcement member 228. For example, as shown in FIGS. 10 and 11, where the depth 309 is less than or the same as the largest dimension of the reinforcement member, at least one of the frame element and the secondary part can be joined directly with the reinforcement member, optionally by plasticizing or melting the at least one of the frame element and the secondary part by sonic welding it to the reinforcement member 228.

Figure 12:
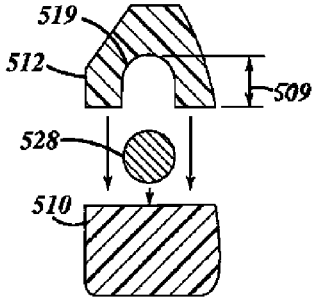
FIG. 12 is a fourth embodiment of the frame element and reinforcement member before sonic welding.

As shown in FIG. 12, where the pre-selected depth 509 is greater than the largest dimension, or where the combined depths of opposing recesses is greater than the largest dimension of the reinforcement member 228, such as that of recesses 220 and 219 in FIG. 9, the frame element and the secondary part can be sonically welded together without direct bonding of either component to the reinforcement member. In other words, the reinforcement member can be housed within one or more recesses, without being bonded or joined directly to either the frame element or the secondary part. Optionally, in such a construction, a gap or void 229 can be defined between the reinforcement member 228, the frame element 210 and/or the secondary part 212.

This configuration can fixedly restrain the reinforcement member in the recess, yet enable the reinforcement member to float or move freely within the recess, for example by rotation, or by moving toward and away from the respective secondary part and/or frame element within the gap, while still providing strength and rigidity to the head in the frame element. Further optionally, the reinforcement member can be bonded or joined directly to only one of the secondary part and the frame element, or to either or both in certain areas along the member, to provide localized joining with specific flexing and/or rigidity characteristics.

Figure 10:
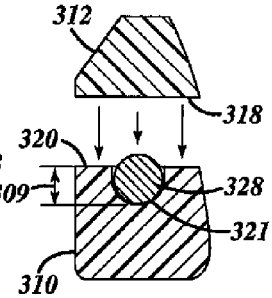
FIG. 10 is a third embodiment of the frame element and reinforcement member before sonic welding.
Figure 11:
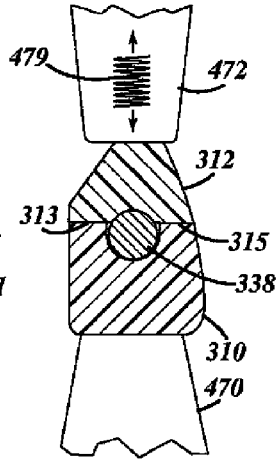
FIG. 11 is the third embodiment of the frame element and reinforcement member after sonic welding.

Referring to FIGS. 10-11, a third embodiment of the reinforced lacrosse head is shown. There, the frame element of the head can be any of the frame elements described above, that is, a sidewall, a base, a scoop, a throat, or portions thereof, and can be generally identical to those described in connection with the embodiments above, with the exception of the frame element first portion 310 and the secondary part 312. Specifically, the frame element 310 but not the secondary part 312, can define a recess, groove or aperture 321 to accommodate the reinforcement member 328. As shown, the engagement surface 320 can define the groove 321, and the engagement surface 318 can be relatively groove-less.

The reinforcement member 328 can be positioned within the recess, so that at least the engagement surface 320 straddles the reinforcement member 328, that is, the engagement surface can include first 313 and second 315 areas on opposite sides of the reinforcement member 328, where those areas are adapted to engage at least the engagement surface 318 or of the secondary part and to be sonically welded thereto. Specifically, the secondary part 312 and the frame element portion 310 can be joined by compressing them together between the anvil 470 and sonotrode 472, while applying high frequency vertical vibrations 479 to the secondary part and the frame element to sonically weld them together and form a completed frame element as shown in FIG. 11. In this embodiment, the groove 321 can be of a pre-selected depth that is less than the greatest cross sectional dimension of the member 328, which enables at least one of the frame element 310 and the secondary part 312 to bond or join directly with the surface of the reinforcement member.

Figure 13:
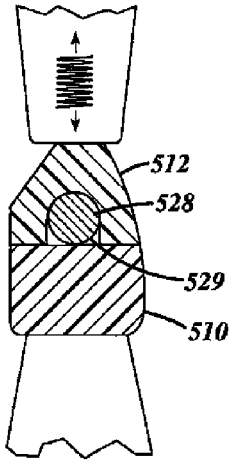
FIG. 13 is the fourth embodiment of the frame element and reinforcement member after sonic welding.
Figure 14:
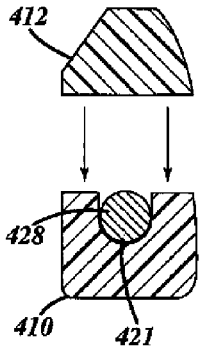
FIG. 14 is a fifth embodiment of the frame element and reinforcement member before sonic welding.
Figure 15:
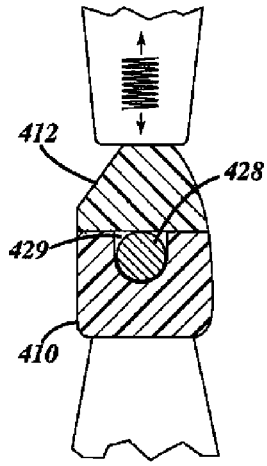
FIG. 15 is the fifth embodiment of the frame element and reinforcement member after sonic welding.

Referring to FIGS. 12-13, and FIGS. 14-15, fourth and fifth embodiments of the reinforced lacrosse head is shown. There, the frame element of the head can be any of the frame elements described above, that is, a sidewall, a base, a scoop, a throat, or portions thereof, and are generally identical to those described in connection with the embodiments above, with the exception of the frame element first portions 410, 510 and the secondary part 412, 512. Specifically, in these respective embodiments, the first portion 410, 510 or the secondary part 412, 512 can define a recess, groove or aperture 421 or 519, respectively to accommodate the reinforcement members 428 and 528 respectively. The other opposing part can include an engagement surface that can be relatively groove-less. The reinforcement members 428 and 528 can be positioned within the respective recesses, so that at least the engagement surfaces straddle the reinforcement members, enabling the engagement surfaces of the respective parts to be sonically welded together as shown in FIGS. 13 and 15 as explained in connection with the embodiments above. In these embodiments, the grooves 421, 519 can be of a pre-selected depth that is greater than the greatest cross sectional dimension of the members 428, 528 which enables the members to be embedded in the resulting frame element without being bonded or joined directly with the first portion or the secondary part. Optionally, this enables the reinforcement member to be free floating, as explained in the embodiments above, within the respective recesses as desired.

In a sixth embodiment, a frame element and secondary part can be hot plate welded to include a reinforcement member and thereby form a reinforced lacrosse head. The frame element and secondary part can be constructed to include any of the components or elements as mentioned in the above embodiments, and the reinforcement member can be of any of the constructions mentioned above as well. The primary difference between the aforementioned embodiments and this embodiment is the process for joining the parts, which in this embodiment, uses a hot plate welding process. Like the sonic welding process above, this process generally uses secondary parts and frame elements that are pre-formed. Thus, the issues presented above concerning uneven shrinkage due to cooling of conventional reinforced heads and methods are eliminated or minimized.

Figure 16:
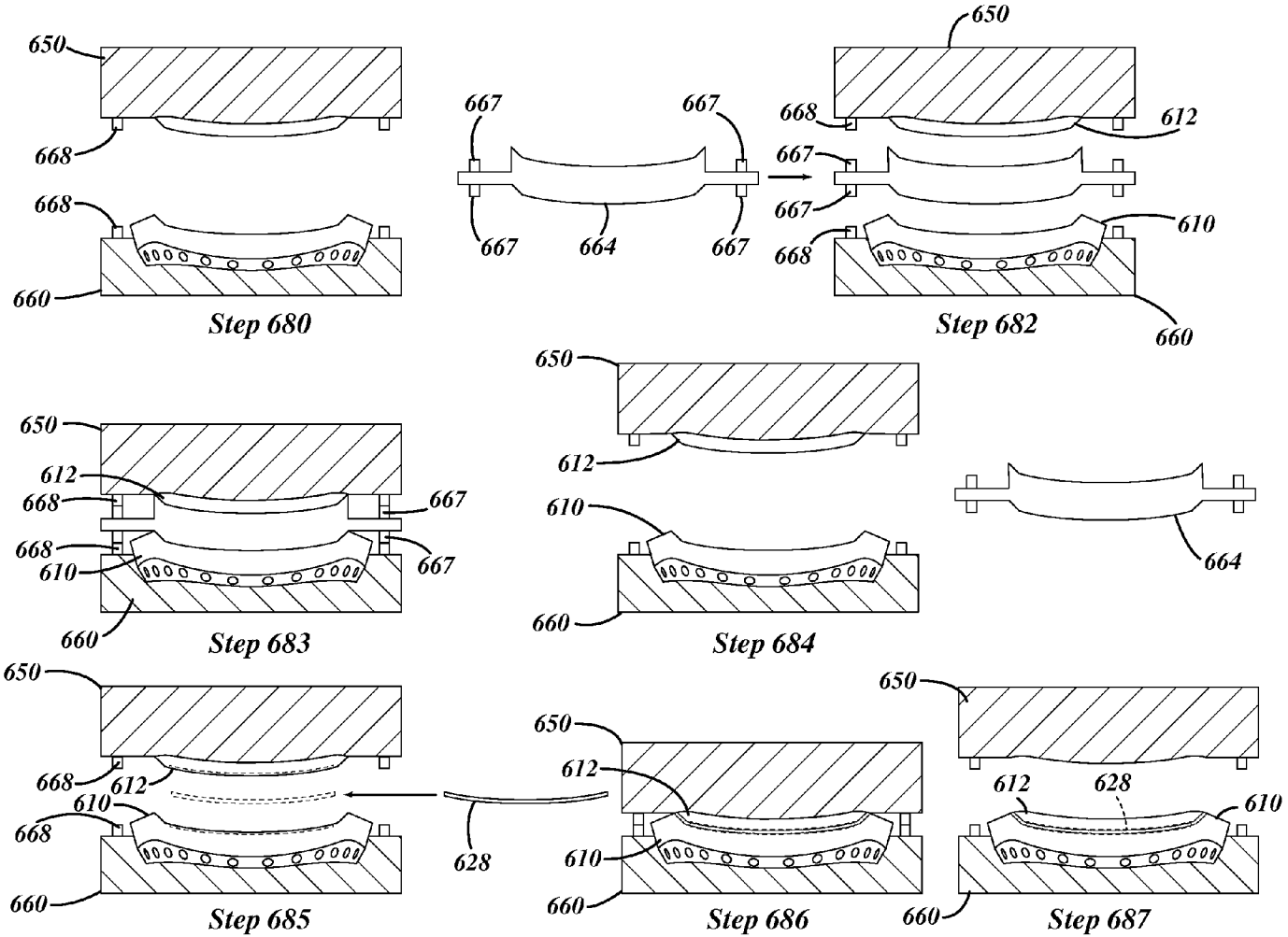
FIG. 16 is a sixth embodiment illustrating a process for hot plate welding a frame element and a secondary part to include a reinforcement member.

With reference to FIG. 16, the process of this embodiment is explained in connection with hot plate welding a frame element 610 and a secondary part 612. As shown in FIG. 16, the frame element 610 is a scoop portion and the secondary part is the lip of the scoop. The scoop and lip are only shown as examples of elements that can be formed using the hot plate welding process. Any other component of the head can be similarly hot plate welded to include a reinforcement member.

The hot plate welding process can include several steps. In step 680, a hot plate welding apparatus including opposing fixtures 650 and 660 are provided. The frame element 610 is positioned in the first fixture 660 and the secondary part 610 is placed in the second fixture 650. A heating platen 664 is also provided. The heating platen 664 can include melt stops 667, while the fixtures 650 and 660 can include weld stops 668. Generally, as shown, at step 680, the secondary part 612 and frame element 610 are held and aligned by the opposing fixtures 650 and 660.

In step 682, the heating platen 664 is inserted between the fixtures 660 and 650, with its components generally aligned with the regions of the frame element 610 and secondary part 612 desired to be heated and melted together. In step 683, the fixture 650 and 660 are brought together so that the platen 664 engages the appropriate surfaces of the secondary part 612 and the frame element 610, thereby at least partially melting the regions and areas that it contacts. In step 684, the platen 664 is removed from between the fixtures 650 and 660. In step 685, the reinforcing member 628 is introduced between the secondary part 612 and the frame element 610. If any optional recesses are included in either of these components, as described in the multiple sonic welding embodiments above, the reinforcing member 628 can be positioned in those recesses. Optionally, the reinforcing member 628 can also be heated so that it further melts into at least one of the secondary part and the frame element 610.

Returning to step 686, the fixture part 650 and 660 are joined together, optionally compressed together, so that areas fuse together as the material of the secondary part 612 and frame element 610 cools. In this process, the reinforcing member 628 becomes at least partially embedded in at least one of the secondary part and the frame element. In step 682, the fixture is opened to expose the lacrosse head, including the frame element and secondary part joined together with the reinforcing member 628 included therein. After this step, the head can be removed from the fixture for various finishing operations as desired.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A method of making a reinforced lacrosse head comprising:

determining a configuration for the lacrosse head having a plurality of lacrosse frame elements including a pair of opposing sidewalls, each sidewall having an open frame to reduce weight of the lacrosse head, a scoop, and a throat adapted to engage a lacrosse handle;

selecting a reinforcement location in at least one lacrosse frame element to reinforce with a reinforcement member;

making a lacrosse frame element including a first engagement surface and allowing the frame element to cure;

making a secondary part including a second engagement surface, and an exterior edge and allowing the secondary part to cure;

placing a reinforcement member between the lacrosse frame element and the secondary part in the reinforcement location;

compressing the secondary part and the lacrosse frame element between a sonotrode and an anvil; and applying ultrasonic oscillations to at least one of the lacrosse frame element and the secondary part so that the first engagement surface and the second engagement surface join one another, at least one of the first engagement surface and the second engagement surface straddling the reinforcement member after having been sonically joined with one another so that the reinforcement member is fixedly restrained between the secondary part and the lacrosse frame element to provide structural rigidity to the lacrosse frame element, wherein the reinforcement member is at least one of joined directly to at least one of the secondary part and the lacrosse frame element and free floating relative to the at least one of the secondary part and the lacrosse frame element, wherein the reinforcement member is disposed a pre-selected distance from the exterior edge of the secondary part to substantially resist at least one of cracking, chipping or breaking of the exterior edge when that edge is impacted by an object.

2. The method of claim 1, wherein at least one of the first and second engagement surfaces defines a groove of a pre-selected depth.

3. The method of claim 2, wherein the reinforcement member is a bar having a greatest cross sectional dimension, wherein the pre-selected depth is less than or equal to the greatest cross sectional dimension, wherein the reinforcement member is joined directly to at least one of the secondary part and the lacrosse frame element.

4. The method of claim 2, wherein the reinforcement member is a bar having a greatest cross sectional dimension, wherein the pre-selected depth is greater than the greatest cross sectional dimension, wherein the reinforcement member is free floating relative to at least one of the secondary part and the lacrosse frame element.

5. The method of claim 1, wherein the reinforcement member is formed in at least one of an upper rim and a lower rim of a sidewall of the lacrosse head, the reinforcement member terminating short of a scoop and a base of the lacrosse head.

6. The method of claim 1, wherein the reinforcement member is formed in an exterior edge of the scoop, the reinforcement member being contained in only the scoop, and terminating short of a pair of sidewalls of the lacrosse head.

7. The method of claim 1, wherein the reinforcement member is an elongated bar extending generally parallel to the frame element, wherein the frame element, the secondary part and the reinforcement member all have different cross sections.

8. The method of claim 1 wherein the reinforcement member is free floating relative to the at least one of the secondary part and the lacrosse frame element, wherein a void is defined between the reinforcement member and the at least one of the secondary part and the lacrosse frame element.

9. The method of claim 1 wherein the first and second engagement surfaces are substantially planar, and wherein the secondary part and the frame element bond to a surface of the reinforcement member.

10. The method of claim 1 wherein a gap is defined between at least a portion of the reinforcement member and at least one of the frame element and the secondary part.

11. A method of making a reinforced lacrosse head comprising:

determining a configuration for the lacrosse head having a plurality of lacrosse frame elements including a pair of opposing sidewalls, each sidewall having an open frame to reduce weight of the lacrosse head, a scoop, and a throat adapted to engage a lacrosse handle;

selecting a reinforcement location in at least one lacrosse frame element to reinforce with a reinforcement member;

making a lacrosse frame element including a first engagement surface and allowing the frame element to cure, wherein the cured lacrosse frame element defines a recess of a first shape that is adapted to receive a secondary part;

making the secondary part including a second engagement surface, and an exterior edge, and allowing the secondary part to cure, wherein the secondary part is of a second shape, corresponding to the first shape, and adapted to fit the recess of the lacrosse frame element;

placing a reinforcement member between the lacrosse frame element and the secondary part in the reinforcement location, wherein at least a portion of the secondary part fits the recess of the lacrosse frame element;

compressing the secondary part and the lacrosse frame element between a sonotrode and an anvil; and applying ultrasonic oscillations to at least one of the lacrosse frame element and the secondary part so that the first engagement surface and the second engagement surface join one another, at least one of the first engagement surface and the second engagement surface straddling the reinforcement member after having been sonically joined with one another so that the reinforcement member is fixedly restrained between the secondary part and the lacrosse frame element to provide structural rigidity to the lacrosse frame element.

12. A method of making a reinforced lacrosse head comprising:

determining a configuration for the lacrosse head having a plurality of lacrosse frame elements including a pair of opposing sidewalls, each sidewall having an open frame to reduce weight of the lacrosse head, a scoop, and a throat adapted to engage a lacrosse handle;

selecting a reinforcement location in at least one lacrosse frame element to reinforce with a reinforcement member;

making a lacrosse frame element including a first engagement surface and allowing the frame element to cure;

making a secondary part including a second engagement surface, and an exterior edge and allowing the secondary part to cure;

heating at least one of the first engagement surface and the second engagement surface with a heating element to melt at least a portion of the at least one of the first engagement surface and the second engagement surface thereby forming at least one melted portion;

holding the lacrosse frame element and the secondary part so that the first engagement surface and the second engagement surface are aligned with one another in opposing relation;

placing a reinforcement member between the lacrosse frame element and the secondary part in the reinforcement location; and compressing the secondary part and the lacrosse frame element so that the first engagement surface and second engagement surface contact one another, with the at least one melted portion engaging at least one of the first engagement surface and the second engagement surface and so that the first engagement surface and the second engagement surface join to one another, at least one of the first engagement surface and the second engagement surface straddling the reinforcement member after having been joined with one another via the melted portion so that the reinforcement member is fixedly restrained between the secondary part and the lacrosse frame element to provide structural rigidity to the lacrosse frame element, wherein the reinforcement member is at least one of joined directly to at least one of the secondary part and the lacrosse frame element and free floating relative to the at least one of the secondary part and the lacrosse frame element, wherein the reinforcement member is disposed a pre-selected distance from the exterior edge of the secondary part to substantially resist at least one of cracking, chipping or breaking of the exterior edge when that edge is impacted by an object.

13. The method of claim 12, wherein at least one of the first and second engagement surfaces defines a groove of a pre-selected depth.

14. The method of claim 13, wherein the reinforcement member is a bar having a greatest cross sectional dimension, wherein the pre-selected depth is less than or equal to the greatest cross sectional dimension, wherein the reinforcement member is joined directly to at least one of the secondary part and the lacrosse frame element.

15. The method of claim 13, wherein the reinforcement member is a bar having a greatest cross sectional dimension, wherein the pre-selected depth is greater than the greatest cross sectional dimension, wherein the reinforcement member is free floating relative to at least one of the secondary part and the lacrosse frame element.

16. The method of claim 12, wherein the reinforcement member is formed in at least one of an upper rim and a lower rim of a sidewall of the lacrosse head, the reinforcement member terminating short of a scoop and a base of the lacrosse head.

17. The method of claim 12, wherein the reinforcement member is formed in an exterior edge of the scoop, the reinforcement member being contained in only the scoop, and terminating short of a pair of sidewalls of the lacrosse head.

18. The method of claim 12, wherein the reinforcement member, the frame element and the secondary part all have different cross sections.

19. The method of claim 12 wherein the reinforcement member is free floating relative to the at least one of the secondary part and the lacrosse frame element, wherein a void is defined between the reinforcement member and the at least one of the secondary part and the lacrosse frame element.

20. The method of claim 12 wherein the first and second engagement surfaces are substantially planar, and wherein the secondary part and the frame element bond to a surface of the reinforcement member.

* * * * *